US011801595B2

(12) United States Patent
Liou

(10) Patent No.: US 11,801,595 B2
(45) Date of Patent: Oct. 31, 2023

(54) TOOL INCLUDING A BUFFER STRUCTURE

(71) Applicant: Tang Chou Industrial Co., Ltd., Nantou County (TW)

(72) Inventor: Mou-Tang Liou, Taichung (TW)

(73) Assignee: Tang Chou Industrial Co., Ltd., Nantou County (TW)

( * ) Notice: Subject to any disclaimer, the term of this patent is extended or adjusted under 35 U.S.C. 154(b) by 148 days.

(21) Appl. No.: 17/464,038

(22) Filed: Sep. 1, 2021

(65) Prior Publication Data

US 2023/0060328 A1 Mar. 2, 2023

(51) Int. Cl.
*B25G 3/38* (2006.01)
*B66F 15/00* (2006.01)

(52) U.S. Cl.
CPC ..... *B25G 3/38* (2013.01); *B66F 15/00* (2013.01)

(58) Field of Classification Search
CPC ..... B25G 3/38; B66F 15/00
USPC ..... 254/131, 131.5; 81/27, 463
See application file for complete search history.

(56) References Cited

U.S. PATENT DOCUMENTS 7,191,685 B2 * 3/2007 Lowther ..... B25B 27/02 81/463
8,486,084 B2 * 7/2013 Huene ..... A61B 17/92 606/100
9,868,202 B1 * 1/2018 Burcham ..... B25G 3/36
11,059,157 B2 * 7/2021 Fu ..... B25F 1/006
2019/0084817 A1 * 3/2019 Zhang ..... B25C 11/00

FOREIGN PATENT DOCUMENTS

TW I648133 B 1/2019

* cited by examiner

*Primary Examiner* — Lee D Wilson
*Assistant Examiner* — Shantese L McDonald

(57) ABSTRACT

A tool including a buffer structure adapted to prevent shocks includes a tool head, a first shaft structure, and a second shaft structure. The tool head has a first connecting portion. The second shaft structure is attached to the slide and links with the tool head. The second shaft structure is movable with respect to the first shaft structure such that the tool head is moved toward and away from the first shaft structure. The second shaft structure has a second connecting portion receiving the pivot. The tool head is pivotal with respect to the second shaft structure. Further, a resilient member is disposed between the first and the second shaft structures. The second shaft structure is biased by the resilient member.

13 Claims, 9 Drawing Sheets

TOOL INCLUDING A BUFFER STRUCTURE

BACKGROUND OF THE INVENTION

1. Field of the Invention

The present invention relates to a tool including a buffer structure adapted to prevent shocks from damaging connections of components of the tool.

2. Description of the Related Art

Taiwan Pat. No. I648133 shows a crowbar tool with one claw adapted to exchange positions with respect to another claw. The tool includes a main body and a group of prying members pivotally coupled together by a pivoting mechanism. The main body extends along an axis and has a first and a second connecting parts which extend radially to the axis and arranged on two different sides of the axis.

In a situation where the tool is stuck under a work piece to be pried, a user generally applies an external force to hit the tool so as to loosen it from the work piece and create a gap for reinsertion. The impact of the external force, however, causes damage to the pivoting mechanism.

The present invention is, therefore, intended to obviate or at least alleviate the problems encountered in the prior art.

SUMMARY OF THE INVENTION

According to the present invention, there is disclosed a tool including a buffer structure adapted to prevent shocks from damaging connections of components of the tool. The tool includes a tool head, a first shaft structure, and a second shaft structure.

The tool head has a first connecting portion. The second shaft structure is movably coupled to the first shaft structure and links with the tool head. The second shaft structure is movable with respect to the first shaft structure such that the tool head is moved toward and away from the first shaft structure. The second shaft structure has a second connecting portion pivotally connected with the first connecting portion. The tool head is pivotal with respect to the second shaft structure. Further, a resilient member is disposed between the first and the second shaft structures. The second shaft structure is biased by the resilient member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the public generally, and especially scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
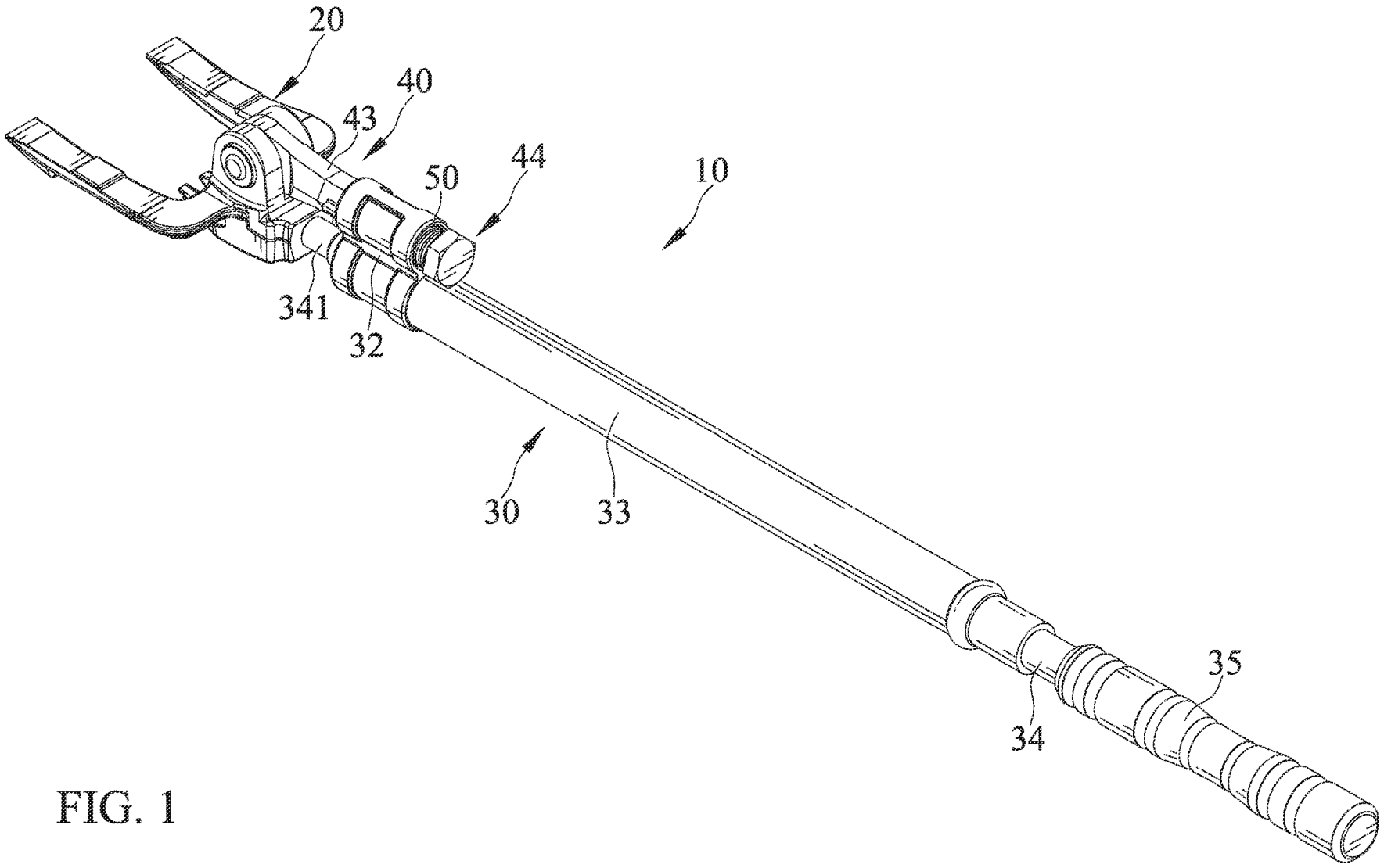
FIG. 1 is a perspective view of a tool including a buffer structure in accordance with a first embodiment of the present invention.
Figure 2:
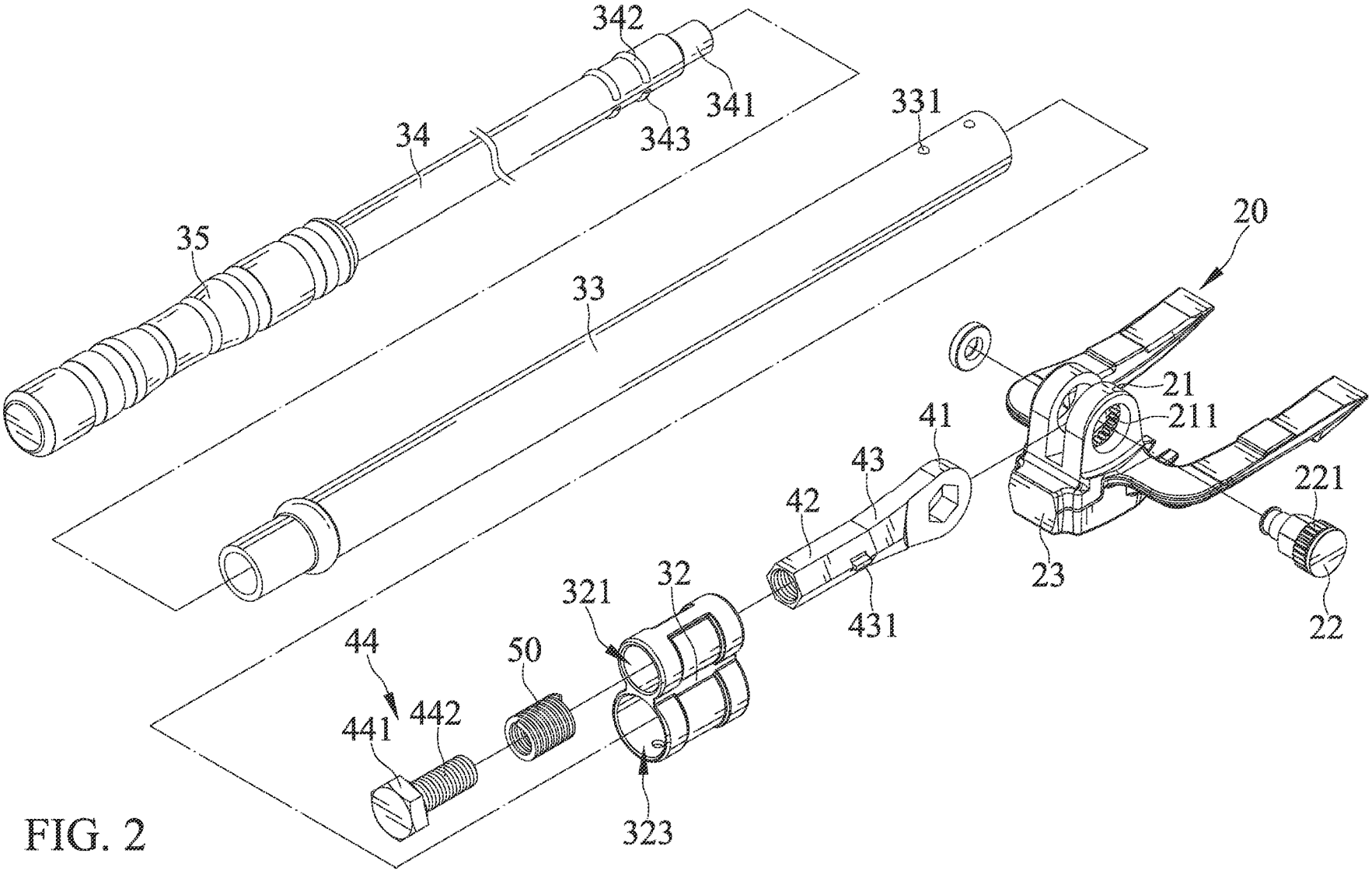
FIG. 2 is an exploded perspective view of the tool.
Figure 3:
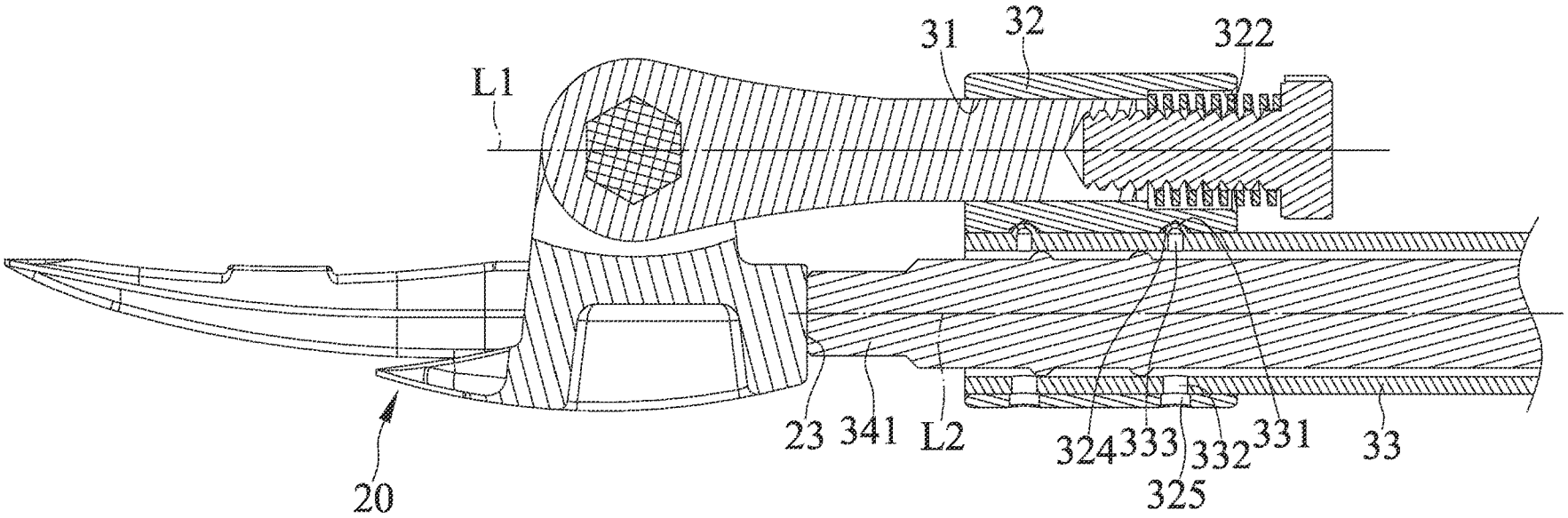
FIG. 3 is a cross-sectional view of a first end of the tool.
Figure 4:
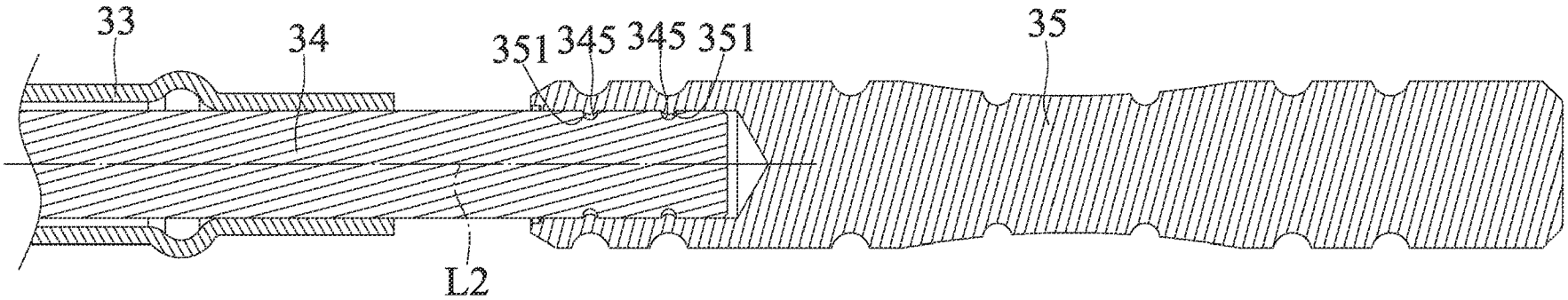
FIG. 4 is cross-sectional view of a second end of the tool.
Figure 5:
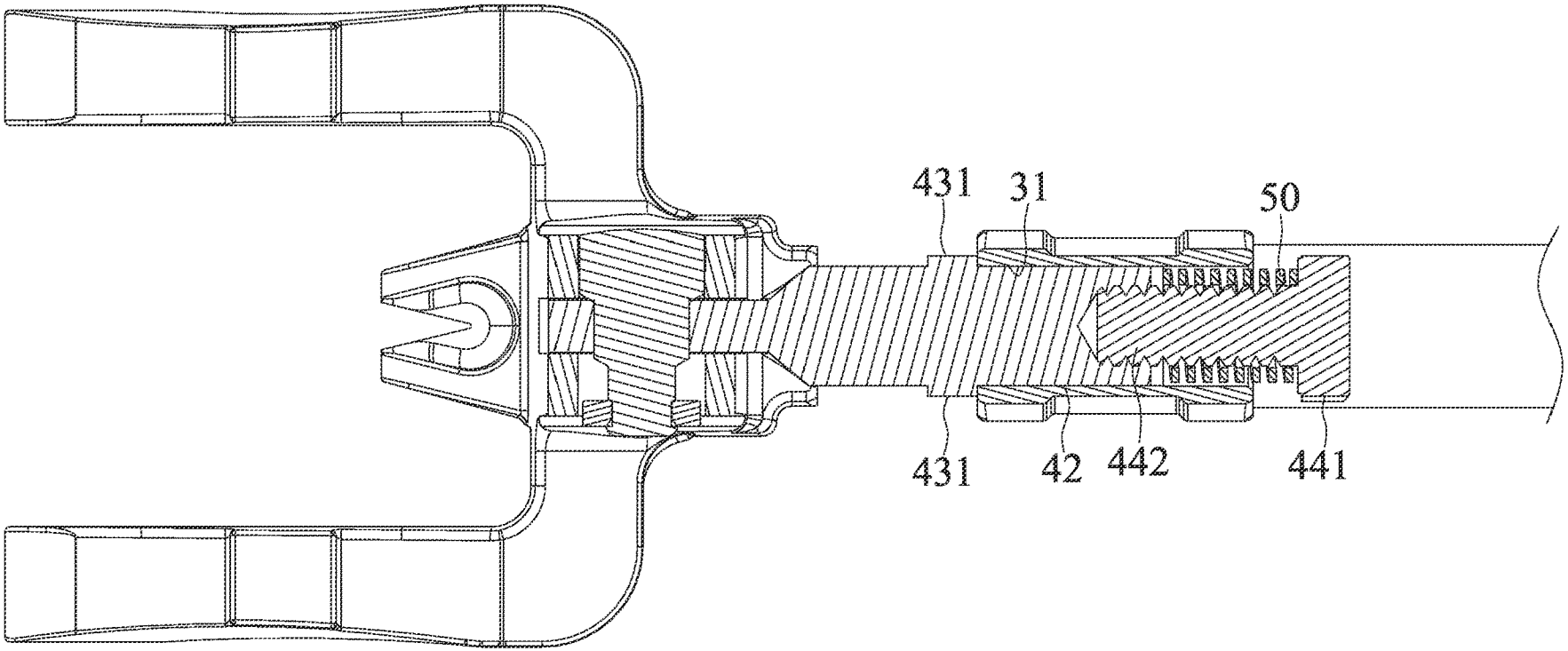
FIG. 5 is another cross-sectional view of the first end of the tool.
Figure 6:
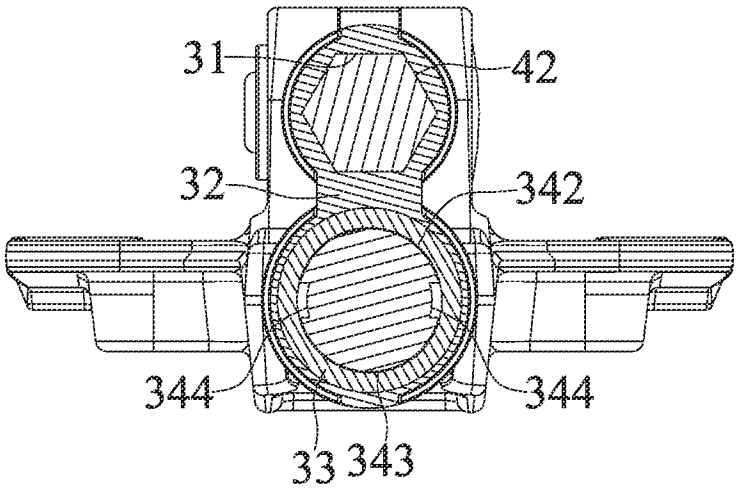
FIG. 6 is another cross-sectional view of the first end of the tool.
Figure 7:
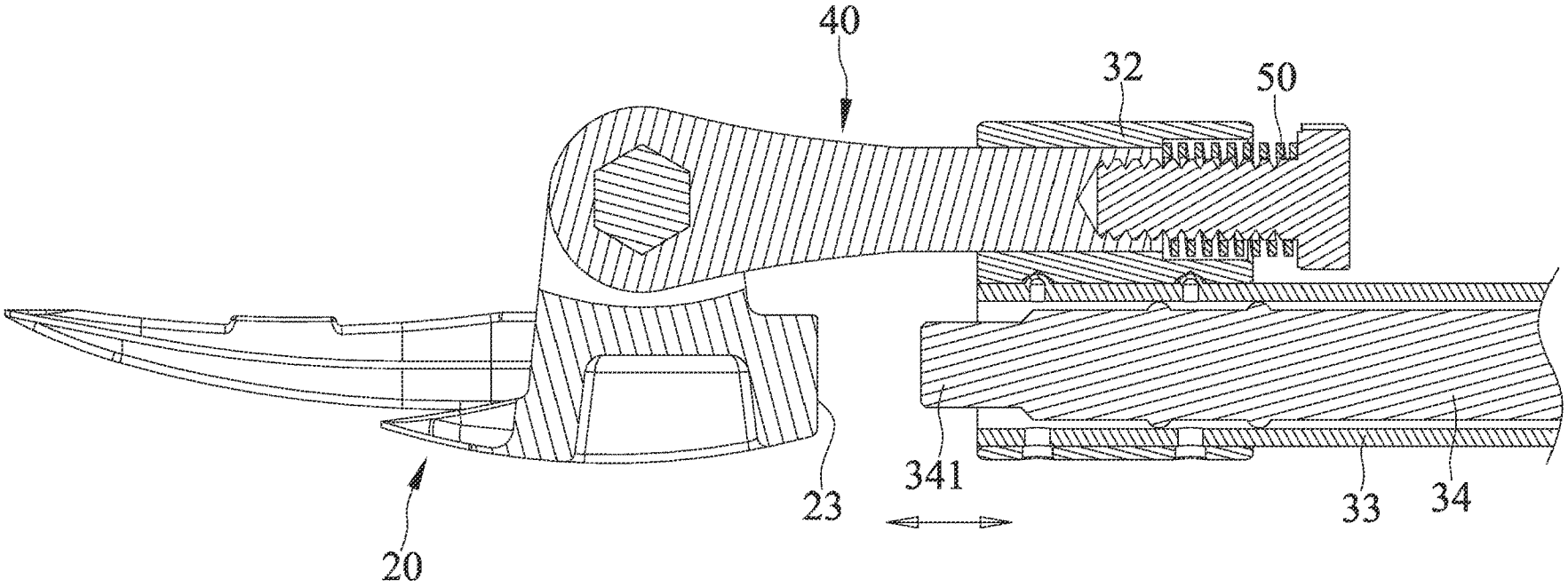
FIG. 7 is a cross-sectional view illustrating a hitting shaft of the tool moved to a position different from that of FIG. 3.

FIGS. 1 through 7 show a tool 10 including a buffer structure in accordance with a first embodiment of the present invention. The tool 10 is adapted to prevent shocks from damaging connections of components of the tool 10. The tool 10 has a tool head 20 having a connecting portion 21 receiving a pivot 22. The connecting portion 21 is in a form of a hole and includes teeth 211. The pivot 22 is inserted into the hole of the connecting portion 21 and includes teeth 221 engagable with the teeth 211. The tool 10 further includes a shaft structure 30. When the teeth 211 and 221 are engaged with each other, the tool head 20 is restrained from pivoting with respect to the shaft structure 30. The shaft structure 30 includes a body defining a slide 31. The slide 31 is of hexagonal cross section.

The tool 10 further includes a shaft structure 40 which has a connecting portion 41 receiving the pivot 22. The tool head 20 is pivotal with respect to the shaft structure 40. The shaft structure 40 is disposed on the shaft structure 30 and links with the tool head 20. The shaft structure 40 is attached to the slide 31. The shaft structure 40 is movable with respect to the shaft structure, i.e., on the slide 31, such that the tool head 20 is moved toward and away from the shaft structure 30. The slide 31 is in a form of a sleeve 32. The sleeve 32 has a hole 321 receiving the shaft structure 40 which includes a rod 43 with a holding structure 44 which prevents the rod 43 detaching from the sleeve 32. The connecting portion 41 is on the rod 43. The rod 43 has a sliding end 42 corresponding to the slide 31 and the sliding end 42 is of hexagonal cross section. The slide 31 is adapted to stop the shaft structure 40. The slide 31 abuts at least one stopping portion 431 of the rod 43 to stop the shaft structure 40. The at least one stopping portions 431 includes two stopping portions 431 on opposite sides of the rod 43. The at least one stopping portion 431 is in a form of a protrusion and disposed outside the hole 321.

The shaft structure 40 is movable axially along an axis L1 with respect to the shaft structure 30. The holding structure 44 has a wide portion 441 and a narrow portion 442, which has a smaller radius than that of the wide portion 441. Moreover, the sleeve 32 has a hole 323 receiving the shaft structure 30 which includes a tube 33 and a hitting rod 34 received in a hollow of the tube 33. The holes 321 and 323 are parallel to each other.

The hole 323 has at least one retaining portion 324 in a form of a recess and the sleeve 32 includes at least one through hole 325 extending radially therethrough from the hole 323. The tube 33 has at least one retaining portion 331 in a form of a protrusion and includes at least one through hole 332 extending radially therethrough. The at least one retaining portion 331 engages with the at least one retaining portion 324. The at least one through hole 325 and the at least one through hole 332 are open to each other. The at least one retaining portion 324, the at least one retaining portion 331, the at least one through hole 325, and the at least one through hole 332 are aligned. The tube 33 has a slot 333 corresponding to the at least one second retaining portion 331. The slot 333 extends radially from the hollow of the tube 33. The slot 333 enables the dispersibility of the at least one retaining portion 331, thereby facilitating engagement and disengagement of the at least one retaining portion 324 and the at least one retaining portion 331.

The hitting rod 34 is movable in the tube 33 axially along an axis L2. The axis L2 is parallel to the axis L1. The hitting rod 34 moves with respect to the tube 33 upon moving a handle 35. The handle 35 is disposed on the hitting rod 34 at an end. The hitting rod 34 has at least one retaining structure 345 in a form of a recess for retaining the handle 35. The handle 35 has at least one retaining structure 351 in a form of a protrusion engaging with the at least one retaining structure 345. The hitting rod 34 is adapted to abut the tool head 20. The tool head 20 has a face 23 and the hitting rod 34 is movable between a first position in which a hitting portion 341 contacts with the face 23 and a second position in which the hitting portion 341 is separated from the face 23. The hitting portion 341 is at an end of the hitting rod 34 different from that of the handle 35. The hitting rod 34 has an outer periphery spaced from an inner periphery of the hollow of the tube 33. The hitting rod 34 includes at least one ridge 342 and at least one ridge 343 abutting the inner periphery of the hollow of the tube 33. The at least one ridge 342 and the at least one ridges 343 extend on an outer periphery of the hitting rod 34 circumferentially and include corresponding first ends thereof separated by a first air channel 344 and corresponding second ends thereof separated by a second air channel 344. The first and the second air channels 344 extend on the outer periphery of the hitting rod 34 and are spaced from the inner periphery of the hollow of the tube 33 radially. The air channels 344 can reduce resistance between the tube 33 and the hitting rod 34 and thus facilitate movement of the hitting rod 34 with respect to the tube 33.

The shaft structures 30 and 40 include a resilient member 50 disposed therebetween so as to bias the shaft structure 40. The hole 321 has an accommodating portion 322 receiving the resilient member 50. The resilient member 50 is restrained between an end wall of the accommodating portion and the holding structure 44. The resilient member 50 is disposed circumferentially on an outer periphery of the holding structure 44. The accommodating portion 322 extends from a portion of the hole 321 along the axis L1, and the accommodating portion 322 is of a radius lager than that of the portion of the hole 321. The resilient member 50 is restrained between the end wall of the accommodating portion 322 and the wide portion 441 of the holding structure 44.

Figure 8:
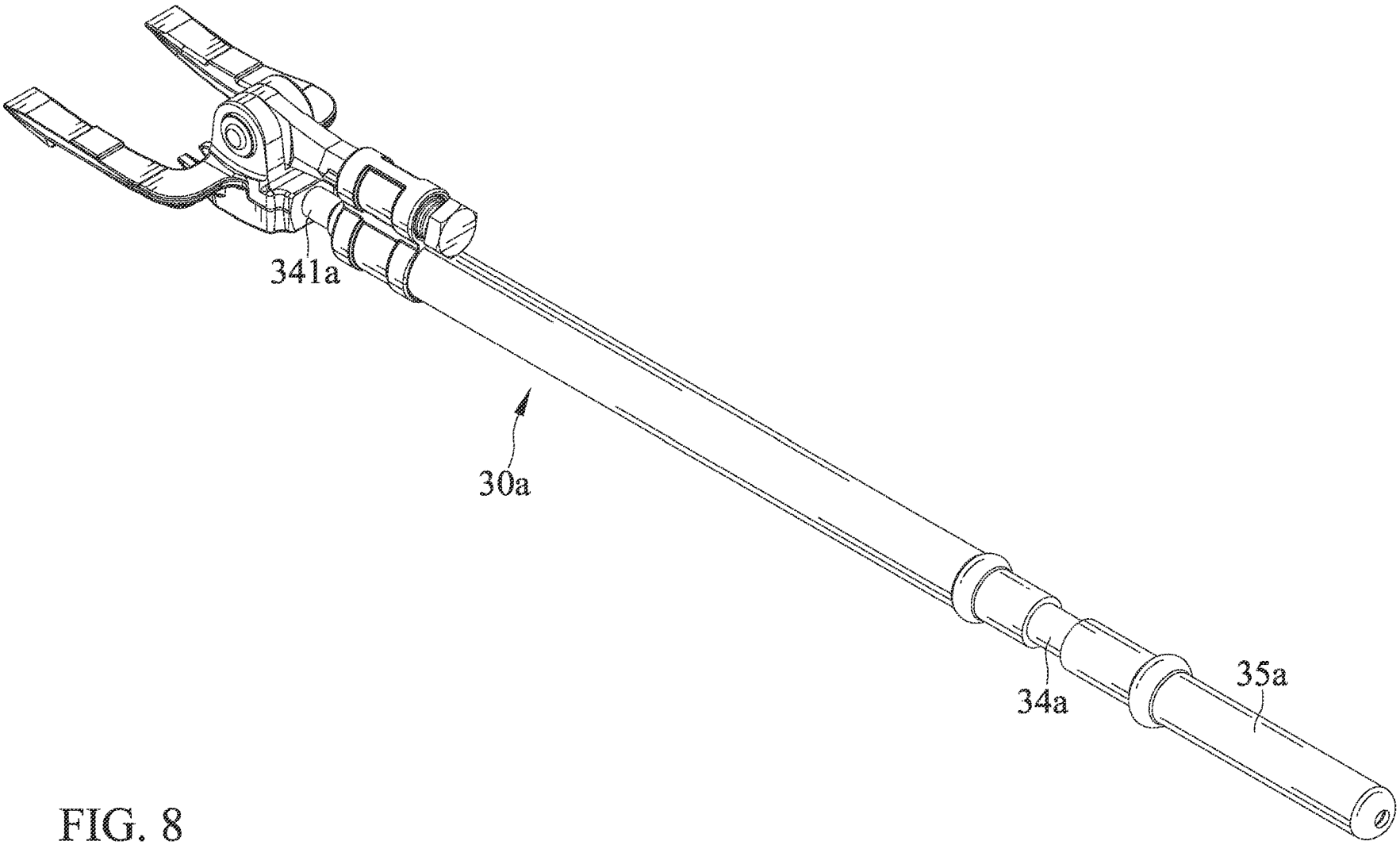
FIG. 8 is a perspective view of a tool including a buffer structure in accordance with a second embodiment of the present invention.
Figure 9:
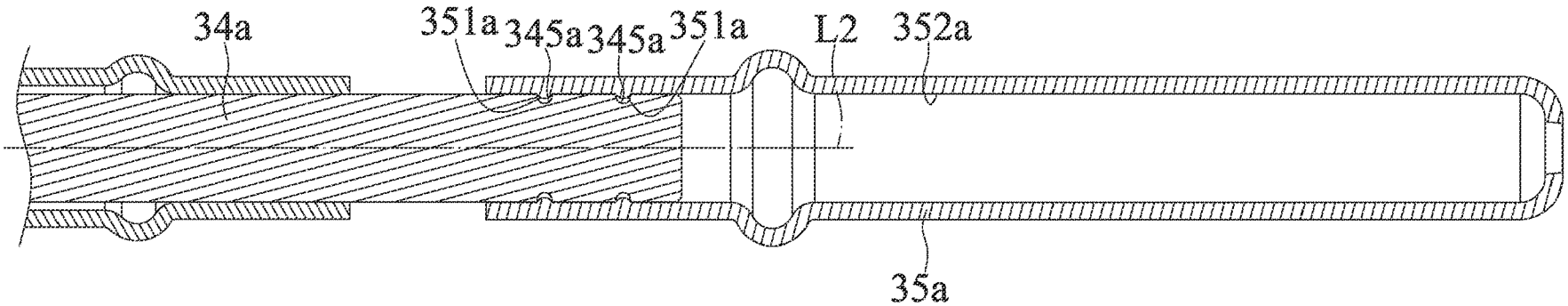
FIG. 9 is a cross-sectional view of the tool shown in FIG. 8.

FIGS. 8 and 9 show a tool including a buffer structure in accordance with a second embodiment of the present invention, and the same numbers are used to correlate similar components of the first embodiment, but bearing a letter a. The second embodiment includes a hitting rod 34*a* having a hitting portion 341*a* and at least one retaining structure 345*a* and a handle 35*a* having at least one retaining structure 351*a* except that the handle 35*a* which is hollow which defines a void 352*a* extending through two opposite ends of the handle 35*a*.

In view of the foregoing, the tool head 20 and the first and the second shaft structures 30 and 40 are interconnected in a manner which buffers shocks and thus prevents damaging connections therebetween when using the tool on a work piece.

The foregoing is merely illustrative of the principles of this invention and various modifications can be made by those skilled in the art without departing from the scope and spirit of the invention.

What is claimed is:

1. A tool including a buffer structure adapted to prevent shocks from damaging connections of the tool, comprising:

a tool head having a first connecting portion;

a first shaft structure;

a second shaft structure movably coupled to the first shaft structure and linking with the tool head, wherein the second shaft structure is movable with respect to the first shaft structure such that the tool head is moved toward and away from the first shaft structure, wherein the second shaft structure has a second connecting portion pivotally connected with the first connecting portion, and wherein the tool head is pivotal with respect to the second shaft structure; and a resilient member disposed between the first and the second shaft structures, wherein the second shaft structure is biased by the resilient member;

wherein the first shaft structure defines a slide in a form of a sleeve, wherein the sleeve has a first hole receiving the second shaft structure which includes a rod with a holding structure which prevents the rod detaching from the sleeve, and wherein the second connecting portion is on the rod.

2. The tool as claimed in claim 1, wherein the first connecting portion is in a form of a hole and includes first teeth, wherein the first and the second connecting portions receive a pivot, and wherein the pivot is inserted into the hole of the first connecting portion 21 and includes second teeth engageable with the first teeth.

3. The tool as claimed in claim 1, wherein the second shaft structure is movable axially along a first axis with respect to the first shaft structure, wherein the first hole has an accommodating portion receiving the resilient member, and wherein the resilient member is restrained between an end wall of the accommodating portion and the holding structure.

4. The tool as claimed in claim 3, wherein the sleeve has a second hole receiving the first shaft structure which includes a tube and a hitting rod received in a hollow of the tube, wherein the hitting rod is movable in the tube axially along a second axis, wherein the second axis is parallel to the first axis, wherein the hitting rod is adapted to abut the tool head, wherein the tool head has a face and the hitting rod has a hitting portion adapted to contact the face, and wherein the hitting rod is movable between a first position in which a hitting portion contacts with the face and a second position in which the hitting portion is separated from the face.

5. The tool as claimed in claim 4, wherein the hitting rod has an outer periphery spaced from an inner periphery of the hollow of the tube, wherein the hitting rod includes at least one first ridge and at least one second ridge abutting the inner periphery of the hollow of the tube, wherein the at least one first and the at least one second ridges extend on an outer periphery of the hitting rod circumferentially and include corresponding first ends thereof separated by a first air channel and corresponding second ends thereof separated by a second air channel, and wherein the first and the second air channels extends on the outer periphery of the hitting rod and spaced from the inner periphery of the hollow of the tube radially.

6. The tool as claimed in claim 4, wherein the second hole has at least one first retaining portion in a form of a recess and the sleeve includes at least one first through hole extending radially therethrough from the second hole, wherein the tube has at least one second retaining portion in a form of a protrusion and includes at least one second through hole extending radially therethrough, wherein the at least one second retaining portion engages with the at least one first retaining portion, wherein the at least one first and the at least one second through holes are open to each other, wherein the at least one first and the at least one second retaining portions and the first and the second through holes are aligned, wherein the tube has a slot corresponding to the at least one second retaining portion, and wherein the slot extends radially from the hollow of the tube.

7. The tool as claimed in claim 4, wherein the hitting rod moves with respect to the tube upon moving a handle, and wherein the handle is disposed on the hitting rod at an end different from an end of the hitting portion.

8. The tool as claimed in claim 7, wherein the hitting rod has at least one first retaining structure in a form of a recess for retaining the handle, and wherein the handle has at least one second retaining structure in a form of a protrusion engaging with the at least one first retaining structure.

9. The tool as claimed in claim 7, wherein the handle is hollow which defines a void extending through two opposite ends of the handle.

10. The tool as claimed in claim 1, wherein the slide is adapted to stop the second shaft structure, and wherein the slide abuts at least one stopping portion of the rod to stop the second shaft structure.

11. The tool as claimed in claim 10, wherein the at least one stopping portion includes two stopping portions on opposite sides of the rod.

12. The tool as claimed in claim 10, wherein the slide is of hexagonal cross section, and wherein the rod has a sliding end corresponding to the slide and the sliding end is of hexagonal cross section.

13. The tool as claimed in claim 10, wherein the at least one stopping portion is in a form of a protrusion and disposed outside the first hole.

* * * * *